US006180583B1

(12) United States Patent
Cilley et al.

(10) Patent No.: US 6,180,583 B1
(45) Date of Patent: Jan. 30, 2001

(54) CLEANING COMPOSITIONS CONTAINING SHORT-CHAIN SURFACTANTS

(75) Inventors: William Ajalon Cilley, Cincinnati; Donald Ray Brown, Middletown, both of OH (US)

(73) Assignee: The Procter & Gamble Company, Cincinnati, OH (US)

( * ) Notice: Under 35 U.S.C. 154(b), the term of this patent shall be extended for 0 days.

(21) Appl. No.: 08/720,584

(22) Filed: Oct. 2, 1996

Related U.S. Application Data

(63) Continuation of application No. 08/566,371, filed on Dec. 1, 1998, now abandoned, which is a continuation of application No. 08/396,370, filed on Feb. 28, 1995, now abandoned, which is a continuation of application No. 08/083,412, filed on Jun. 28, 1993, now abandoned, which is a continuation-in-part of application No. 07/970,665, filed on Nov. 3, 1992, now abandoned.

(51) Int. Cl.[7] ..... C11D 1/37

(52) U.S. Cl. ..... 510/373; 510/427; 510/428; 510/429

(58) Field of Search ..... 510/428, 427, 510/429, 373

(56) References Cited

U.S. PATENT DOCUMENTS

| | | | | |
|---|---|---|---|---|
| Re. 34,065 | | 9/1992 | Wainberg et al. | 252/104 |
| 3,886,079 | * | 5/1975 | Burke, Jr. | 252/109 |
| 3,983,078 | | 9/1976 | Collins | 252/540 |
| 3,996,149 | * | 12/1976 | Burke, Jr. | 252/160 |
| 4,005,027 | * | 1/1977 | Hartman | 252/95 |
| 4,071,463 | * | 1/1978 | Steinhauer | 252/103 |
| 4,272,395 | | 6/1981 | Wright | 252/106 |
| 4,282,109 | * | 8/1981 | Citrone et al. | 252/102 |
| 4,552,680 | | 11/1985 | Hartman et al. | 252/102 |
| 4,588,514 | | 5/1986 | Jones et al. | 363/98 |
| 4,663,071 | * | 5/1987 | Bush et al. | 252/174.19 |
| 4,789,495 | | 12/1988 | Cahall et al. | 252/95 |
| 4,921,627 | | 5/1990 | Copeland et al. | 252/99 |
| 4,923,523 | | 5/1990 | Schluessler | 134/25.3 |
| 4,941,988 | * | 7/1990 | Wise | 252/99 |
| 4,975,216 | | 12/1990 | Schluessler | 252/106 |
| 4,986,926 | | 1/1991 | Hoffman | 252/98 |
| 5,075,025 | | 12/1991 | Wainberg et al. | 252/95 |
| 5,076,954 | | 12/1991 | Loth et al. | 252/122 |
| 5,300,242 | * | 4/1994 | Nichols et al. | 252/38 |

FOREIGN PATENT DOCUMENTS

| | | | | |
|---|---|---|---|---|
| 858460 | | 9/1976 | (BE) . | |
| 3527910 A1 | | 2/1987 | (DE) | D06L/3/06 |
| 4025065 A1 | * | 2/1992 | (DE) . | |
| 137871 | | 4/1985 | (EP) | C11D/1/75 |
| 156438 | | 10/1985 | (EP) | C11D/3/395 |
| 177109 | | 4/1986 | (EP) | C11D/1/12 |
| 316152 | | 5/1989 | (EP) | C11D/3/08 |
| 316726 | | 5/1989 | (EP) | C11D/17/00 |
| 337516 | | 10/1989 | (EP) | C11D/3/395 |
| 373864 | | 6/1990 | (EP) | C11D/3/395 |
| 421738 A2 | | 10/1990 | (EP) | C11D/3/395 |
| 0421738 | * | 4/1991 | (EP) . | |
| 2135241 | | 12/1972 | (FR) | C11D/7/00 |
| 2207981 | | 6/1974 | (FR) | C11D/1/72 |
| 1458798 | | 12/1976 | (GB) | C11D/1/83 |
| 1519433 | | 7/1978 | (GB) | C11D/1/72 |
| 3163198 | | 7/1991 | (JP) | A61K/7/50 |
| WO 91/10718 | | 7/1991 | (WO) | C11D/1/83 |
| WO 92/02604 | | 2/1992 | (WO) | C11D/1/83 |
| WO 93/08248 | | 4/1993 | (WO) | C11D/1/72 |
| WO 93/15172 | | 8/1993 | (WO) | C11D/1/83 |

* cited by examiner

*Primary Examiner*—John R Hardee
(74) *Attorney, Agent, or Firm*—Richard S. Echler, Sr.; Kim William Zerby; Steven W. Miller

(57) ABSTRACT

Short-chain surfactants such as octyl sulfate are used to provide a solvent-like cleaning function in detergent compositions. Preferred bleach-containing hard surface cleaners comprising the short-chain surfactants and long-chain surfactants, are especially useful for bathroom and kitchen clean-up operations. Compositions with long-plus-short chain surfactants including alkyl sulfates, olefin sulfonates, amine oxides and the like, are disclosed.

7 Claims, No Drawings

CLEANING COMPOSITIONS CONTAINING SHORT-CHAIN SURFACTANTS

CROSS-REFERENCE TO RELATED APPLICATION

This is a continuation of application Ser. No. 08/566,371, Dec. 1, 1998 now abandoned, which is a continuation of application Ser. No. 08/396,370, filed on Feb. 28, 1995 now abandoned which is a continuation of application Ser. No. 08/083,412, filed on Jun. 28, 1993 now abandoned which is a continuation in part of application Ser. No. 07/970,665, filed on Nov. 3, 1992 now abandoned.

TECHNICAL FIELD

The present invention relates to cleaning compositions and methods which employ short-chain surfactants. While not limited to any particular type of cleaning operation, the compositions herein are especially useful as hard surface cleansers, e.g., for use on walls, countertops, floors and the like. The compositions which contain hypochlorite bleach are especially useful for removing kitchen and bathroom dirt, including the greasy soap scum-types of soils that are associated with bathtubs, shower stalls and bathroom sinks.

BACKGROUND OF THE INVENTION

When considered superficially, it might appear that the formulation of cleaning compositions of various types would be a matter of routinely selecting various detersive surfactants, detersive bleaches and various detersive adjuncts from the wide variety of such materials known in the art, and combining them to achieve whatever level of cleaning performance is desired. However, on further investigation it is found that this is not the case, especially when superior cleaning is desired. For example, many of the myriad, art-disclosed detersive surfactants are little more than technical curiosities designed for use in specialized operations, and are so expensive that they find no practical use in economical cleaning products of interest to the average consumer for custodial cleaning in the home or business. Various bleaches can be used in cleaning, but may be incompatible with various surfactants. Likewise, detersive adjuncts such as abrasives may be suitable for use on some hard surfaces, but be damaging to other surfaces. Accordingly, the formulator of such compositions is faced with difficult choices when developing superior cleaning products.

The formulation of superior cleaning products for use in kitchens and bathrooms provides special challenges, inasmuch as kitchen soils tend to carry a heavy load of greasy and protein-based materials, and bathroom soils tend to carry a heavy load of "soap scum" materials. Moreover, the environmental surfaces, i.e., fixtures, countertops, sinks, tubs, etc., in kitchens and bathrooms are generally made of highly reflective materials, including various types of tile, glass and chrome-plated metal, on which even minor amounts of soil are highly visible. Accordingly, the consumer expects that modern cleaning products will safely and effectively remove even the final traces of dull, unsightly soils from such surfaces.

Historically, kitchen and bathroom cleaners were highly abrasive powders, perhaps with a bit of added surfactant, and were aptly referred to as "scouring" cleansers. They were harsh, not only on the user's hands, but also on the surfaces to which they were applied. Bleaches were later added to such compositions to break down soils and assist in their removal. While modern abrasive cleansers are formulated to be safer on surfaces and more compatible with skin, such cleansers still rely mainly on the action of the abrasive to remove soil, especially the relatively thick, greasy soap scum soils noted above.

With the advent of liquid cleansers, formulators began using certain solvents to improve cleaning performance. Various alcohols, as well as terpenes present in the well-known lemon oil and pine oil cleansers, were used. While in some instances the amount of such solvents did little more than provide an aesthetic benefit, in others the use of pine oil was at such a level that true solvent cleaning benefits were achieved. In still more modern liquid cleansers, materials such as butyl carbitol are used at solvent/cleaning levels. Apparently, however, many formulators of liquid products were still aware that their products did not perform in optimal fashion. In yet another move to enhance cleaning performance, especially against greasy soils, various suspendable abrasives were added to some liquid cleansers.

While the foregoing would appear to provide a natural progression in the formulation of ever-improving cleaning compositions, the use of abrasives, bleaches and solvents is not without its limitations. Too much abrasive, or too harsh an abrasive, limits a product's usefulness. Too much bleach leads to irritation of the user's hands. Too much solvent can yield noxious odors, skin and eye irritation, and, at the extreme, flammability of the product.

In a manner not unlike that seen with hard surface cleansers, the development of fabric laundering compositions has been a progression of steadily improving technologies, starting with common soaps, through synthetic detergents, built detergents, enzyme detergents, up to and including the most modern detergents with bleaches and bleach activators.

Despite of the wide recognition that various liquid solvents can provide outstanding removal of greasy soils and stains from a wide variety of surfaces, comparatively little attention has been paid to the solvent mode of action for cleaning purposes, outside of dry cleaning operations and, as noted, in certain modern hard surface cleansers. Presumably, that may be due to various formulation and other problems associated with the use of solvents. Some solvents may be toxic, malodorous or flammable at effective usage levels. Liquid compositions containing high levels of solvents and ionic ingredients may be unstable, due to the well-known "salting-out" effect. Still other solvents may be so strong as to dissolve various plastic materials with which they come in contact. In any event, the traditional solvents are all liquids, and are thus unsuitable for formulation into powdered or granular cleaning products.

The cleaning action of bleaches can contribute importantly to the overall effectiveness of hard surface cleaners. Unfortunately, the use of conventional hypochlorite bleaches with conventional solvents can lead to instability of liquid cleaning products.

By the present invention, it has been determined that certain "short-chain" surfactants provide a solvent-like cleaning function. Since these short-chain surfactants are water-soluble solids, they can be formulated in either liquid or solid compositions. These short-chain surfactants have low vapor pressures, and have corresponding low odor qualities. They do not suffer from flammability problems associated with many traditional solvents. The short-chain surfactants can be formulated with hypochlorite bleach to provide a most desirable and effective mixed solvent-bleach cleansing action. When formulated in the manner disclosed herein, these short-chain surfactants provide excellent cleaning against kitchen and bathroom soils. In addition, these short-chain surfactants are low sudsing and may be used in fabric cleaning compositions, including the concentrated laundering processes of U.S. Pat. Nos. 4,489,455 and 4,489,574 or in front-loading "European-style" automatic washing machines where sudsing can be problematic.

BACKGROUND ART

U.S. Pat. No. 4,282,109 relates to thickened bleach compositions with amine oxides and alkyl sulfates. U.S. Re Pat. No. 34,065 discloses hypochlorite disinfectants with t-butanol and sodium dodecyl sulfate. See also EP 137,871; BE 858,460; U.S. Pat. No. 4,005,027; EP 156,438; U.S. Pat. No. 4,552,680; and EP 373,864.

SUMMARY OF THE INVENTION

In one aspect, the present invention relates to cleaning compositions which comprise a mixture of:

i) a short-chain water-soluble surfactant which comprises a hydrophilic substituent and one or more hydrophobic hydrocarbyl substituents wherein the maximum chain length of any of said hydrocarbyl substituents is about $C_8$; and ii) one or more conventional long-chain, water-soluble surfactants, wherein the weight ratio of surfactant (i) to surfactant (ii) is greater than 1:1, preferably at least about 2:1, most preferably at least about 4:1, or greater.

Preferred short-chain surfactants for use herein are the $C_6$–$C_8$ alkyl sulfates; also useful are the $C_6$–$C_8$ alkyl sulfonates and the internal alkyl sulfonates. Short-chain ($C_6$–$C_8$) amine oxides are unstable to hypochlorite, but can be used as the short-chain surfactant herein when hypochlorite is not present. Preferred long-chain surfactants are the amine oxides.

In one preferred embodiment of this aspect, a composition according to this invention comprises:

i) at least about 4% by weight of a short-chain surfactant which is a member selected from the group consisting of $C_6$–$C_8$ alkyl sulfates and internal paraffin sulfonates of the formula $$R_1CH(SO_3M)R_2$$

wherein each $R_1$ and $R_2$ is an alkyl substituent, provided that the sum of the carbon atoms in $R_1+R_2$ is no greater than about 10, and neither $R_1$ nor $R_2$ is longer than $C_5$, and M is a cation;

ii) at least about 1% by weight of a long-chain amine oxide surfactant of the formula

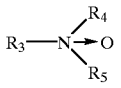

wherein $R_3$ is a $C_{12}$–$C_{20}$ alkyl substituent and $R_4$ and $R_5$ are each $C_1$–$C_3$ alkyl substituents, at a weight ratio of (i):(ii) of about 4:1, or greater.

The invention also provides preferred hard surface cleaning compositions, especially liquids, which additionally comprise a hypochlorite bleach. The liquid compositions herein can additionally comprise a thickener, and such thickened compositions cling to vertical surfaces to assist in cleaning.

In another embodiment, the invention provides liquid, bleach-containing cleaning compositions which comprise:

i) from about 1% to about 2% by weight of a hypochlorite bleach;

ii) from about 0% to about 5% by weight of a bleach-stable, long-chain surfactant (as defined hereinafter) which is a member selected from the group consisting of long-chain amine oxides, long-chain paraffin sulfonates and long-chain alkyl sulfates;

iii) from about 0.6% to about 20% by weight of a short-chain surfactant;

iv) an aqueous carrier, said composition having a pH of about 12, or above, preferably 12–13.

In preferred compositions (especially those containing amine oxide surfactants) the weight ratio of surfactant (iii):surfactant (ii) is greater than 1:1, preferably greater than 2:1, most preferably 4:1, and greater.

Such compositions which comprise from about 1% to about 2% of hypochlorite bleach, about 1% by weight of said long-chain surfactant, and from about 4% to about 8% by weight of said short-chain surfactant, especially wherein the long-chain surfactant is an amine oxide and wherein the short-chain surfactant is octyl sulfate (Na form is convenient), are particularly useful for removing kitchen and bathroom soils. Such compositions can optionally contain a thickener, as noted above.

Solid compositions herein are as noted above, and can use a solid source of chlorine bleach such as sodium dichloroisocyanuate.

In yet another aspect of this invention, it has also now been discovered that compositions without amine oxides perform well and are bleach stable at weight ratios of long-chain:short-chain surfactant of 1:1 and greater as disclosed hereinafter.

The invention also encompasses a method for cleaning hard surfaces by applying thereto a composition according to this invention.

The invention is based on the observation that it is possible to improve the cleaning properties of a cleaning composition which contains at least one long-chain detersive surfactant by admixing with said composition an amount of a short-chain surfactant which preferably comprises at least about 1%, more preferably at least about 2%, by weight of said composition. In embodiments of the invention which contain amine oxides, the amount of short-chain surfactant is greater than the amount of long-chain surfactant, although, in bleach-containing compositions this can be varied, as disclosed more fully hereinafter. This method of improving the cleaning properties of otherwise conventional cleaning compositions by adding "solvent-like" short-chain surfactants is also encompassed by this invention.

All percentages, ratios and proportions recited herein are by weight, unless otherwise specified. All cited documents are incorporated herein by reference.

DETAILED DESCRIPTION OF THE INVENTION

The present invention is based on the discovery that certain short-chain surfactants, as described hereinafter, can co-act with conventional long-chain surfactants to provide a cleaning mechanism which is not unlike that which occurs with solvent cleaners. Stated otherwise, the short-chain surfactants provide a "pseudo-solvent" cleaning function in the compositions. While not intending to be limited by theory, it is speculated that this pseudo-solvent cleaning activity is the result of a disruption in the phase structure of "soap-like" soils and/or reduction of the viscosity of greasy/oily soils by the penetration and diffusion of the short-chain surfactant into such soils.

The following is a listing of the types of materials used in the practice of this invention.

Short-chain Surfactants—As in the case with conventional surfactants, the "short-chain" surfactants used in the practice of this invention comprise a water-solubilizing hydrophilic substituent and at least one, or more, hydrophobic hydrocarbyl substituents. The hydrophilic substituent can be any of the common anionic substituents known for use with detersive surfactants, including especially sulfate (preferred) and sulfonate hydrophilic groups. When preparing compositions herein containing hypochlorite bleaches, short-chain surfactants which contain no oxidizable moieties, i.e., without ethylene oxide, ether links, free hydroxyl groups, amine groups, sulfite groups, or the like, should be chosen. With respect to the hydrophobic portion of the short-chain surfactants, this will typically comprise a hydrocarbyl (alkyl is preferred, but alkenyl may also be employed) group generally containing 8 or less carbon atoms in the longest hydrophobic hydrocarbyl chain and will typically contain from $C_4$–$C_8$ carbon atoms in the longest hydrocarbyl hydrophobic chain. By way of further explanation, 1-octyl sulfate, which is preferred herein, has the sulfate hydrophilic substituent group on the terminal carbon atom, and thus has a $C_8$ chain length. Short-chain internal paraffin sulfonates having the formula $R_2CH(SO_3M)R_2$, as noted hereinabove, will have hydrophilic sulfonate substituent primarily on the second or third carbon of the hydrocarbyl group and thus may be considered to have a chain length in the longest hydrophobic portion of the molecule of about $C_8$ or $C_7$, respectively, not counting the carbon atom to which the $SO_3$ moiety is attached.

It has been determined that very distinct optima in the "solvent-type" cleaning performance of the sulfated short-chain surfactants occur as a function of the chain length of the hydrophobic group. In particular, pseudo-solvent cleaning performance of the preferred sulfate short-chain surfactants occurs at 1-hexyl sulfate and 1-octyl sulfate.

Typical usage levels of the short-chain surfactants are from about 2% to about 8% by weight of the compositions herein.

Long-chain Surfactants—The "long-chain" detersive surfactants herein comprise any of the conventional, water-soluble detersive surfactants which are well-known in the literature for conventional use in cleaning compositions. Such materials include, for example, the $C_{12}$–$C_{20}$ alkyl sulfates, the $C_{12}$–$C_{20}$ alkyl and alkenyl sulfonates, the $C_{12}$ and higher alkyl benzene sulfonates, the $C_{12}$ and higher phosphine oxides, the $C_{12}$ and higher dialkyl amine oxides, especially including the dodecyl dimethyl amine oxide ($C_{12}$ dimethyl amine oxide), which is a preferred type of material for use herein, and the like. The long-chain anionics exhibit their best performance when bleach is present. The long-chain amine oxides provide excellent performance, both in the presence and absence of bleach. Typical examples of a wide variety of long-chain detersive surfactants suitable for use in cleaning compositions, including those of the present invention, are available from standard texts. As noted for the short-chain surfactants, when hypochlorite bleach is used in the liquid compositions herein, it is important to choose long-chain surfactant molecules which have no oxidizable moieties.

Typical usage levels of the long-chain surfactants are from about 0% to about 5% (or 8% for non-amine oxides), more preferably 1%–6%, by weight of the compositions. When hypochlorite stability is desired and an amine oxide is the long-chain surfactant, it is preferably used at about 0.5%–2% levels.

Bleach—Preferred liquid hard surface cleaners herein will contain hypochlorite bleach, which is available as a standard aqueous solution and at pH 12–13. If used, the typical levels of hypochlorite in liquid compositions will be from about 1% to about 2.5% (or as high as 3% for the most stable surfactant amounts and proportions) by weight of the compositions. Solid compositions can contain various solid sources of chlorine bleach, such as sodium dichloroisocyanurate (NaDCC), generally at levels of at least 2%, typically 2%–3%.

Thickener—Liquid compositions of the present invention may optionally be prepared without thickener. However, for many uses it is preferred to have a thickener present in order to promote adhesion of the composition to the surface being cleansed. While various thickeners may be used, it is preferred for stability reasons to employ cross-linked polyacrylic acid thickeners when preparing compositions with hypochlorite bleach. One such thickener is available from the 3-V Chemical Corporation under the tradename POLYGEL DK. This thickener is an anionic carboxy vinyl polymer which is in the form of a fine white powder which, after full or partial neutralization with alkali, forms viscous solutions or gels which are compatible with electrolytes. It has now been determined that such viscous solutions are also stable with hypochlorite bleach, especially in the presence of sodium benzoate stabilizer.

If used, the typical usage levels of polymeric thickener will be from about 1% to about 2% by weight of the compositions.

Fatty acids in the chain length range of from about $C_{12}$–$C_{18}$ can be used to provide thickened compositions. Typical usage levels are 0.5% to 1.5% by weight of total composition. If bleach is present, the fatty acids should be saturated to avoid interaction with the bleach.

Other thickeners useful herein both with and without hypochlorite include clays, especially bentonite, hectorite or other montmorillonite clays. Commercial clays suitable for use herein include HECTABRITE DP, MAGNABRITE HV, POLARGEL HV, VOLCLAY NF-BC, LAPONITE XLS, BENTONE EW and GELWHITE H-NF. Typical usage levels to achieve thickening are at least about 1.0%, and range from about 1.0% to about 2.5% of the compositions herein.

Thickened solution viscosities will preferably range from about 50 cps to about 300 cps as measured by Brookfield Viscometer.

Fluid Carrier—The preferred liquid compositions of the present invention will typically comprise from about 85% to about 95%, by weight of a fluid carrier, preferably water. Water/alcohol (e.g., ethanol; isopropanol) mixtures can also be employed in liquid formulations which do not contain the chlorine bleach.

Optional Adjunct Materials—Compositions which employ the technology of the present invention involving the pseudo-solvent short-chain surfactants can, in addition to the foregoing ingredients, comprise various optional detersive adjunct materials. For example, for fabric laundering and certain other cleaning operations involving hard water, various detergency builders may be present in the compositions typically at levels from about 5% to about 50%, by weight. Typical builder materials include the zeolites, especially Zeolite A, the polycarboxylate builders, especially citrate and oxydisuccinate builders, and the like. Likewise, such cleaning compositions can, if desired, contain detersive enzymes, including, for example, proteases, amylases, lipases, and the like. The use of detersive enzymes is typically at levels from about 0.01% to about 2% by weight.

Likewise, solid compositions can contain granular carriers, including sodium sulfate, sodium carbonate, and the like. The compositions herein can be formulated as bars useful for hand-washing of fabrics. Abrasives, especially silica and calcium carbonate and commercially-available synthetic abrasives, can be present in the compositions. Powdered cleansers may contain as high as 95% abrasive or solid carrier; liquid cleansers may typically contain up to about 30% by weight of abrasive. Various perfumes, bactericides, sanitizers, colorants, and the like can all be present as optional adjuncts in finished formulations. Soluble carbonates such as sodium carbonate at levels of 0.5% to 2% are particularly useful in liquid and solid cleansers of the present type when hypochlorite is not used.

It is one of the advantages of the present invention that enhanced cleaning performance can be achieved by the addition of the short-chain surfactants herein without otherwise causing the formulator to resort to the use of unconventional ingredients and detersive adjuncts. Accordingly, while the foregoing listing of Optional Adjunct Materials is instructive, it is by no means intended to be limiting of the invention, and other such materials can also be used herein.

Method-of-Use—The compositions of the present invention, especially the liquid compositions and, most particularly, the liquid bleach-containing compositions, are designed for direct application to the surface being cleaned. This is especially true when cleaning bathroom and kitchen soils from bathtubs, countertops, and the like. Application of the product may be by any convenient means, e.g., sponge, pad or the like. In an alternate mode, the compositions herein can be diluted in water prior to application, according to the desires of the user.

Having thus described the invention in substantial detail, the following Examples are included to further illustrate the practice of the invention, but are not intended to be limiting thereof.

EXAMPLE I

An unthickened liquid bleach-containing cleanser for bathrooms and kitchens is prepared by admixing the following ingredients.

| Ingredient | % (wt.) |
|---|---|
| Hypochlorite* | 2.0 |
| $C_{12}$ dimethyl amine oxide | 1.0 |
| Octyl Sulfate (Na) | 4.0 |
| Perfume | 0.2 |
| NaOH (product pH, neat, 12–13) | 0.75 |
| Deionized water | Balance |

*2% total hypochlorite in finished product; added as sodium hypochlorite.

EXAMPLE II (A, B, C)

Thickened liquid bleach-containing cleansers for bathrooms, kitchens and other hard surfaces are as follows.

| | % (wt.) | | |
|---|---|---|---|
| Ingredient | A | B | C |
| Hypochlorite | 1.0 | 2.0 | 2.0 |
| $C_{12}$ dimethyl amine oxide | 1.0 | 1.0 | 1.0 |
| Octyl sulfate (Na) | 4.0 | 8.0 | 4.0 |

-continued

| | % (wt.) | | |
|---|---|---|---|
| Ingredient | A | B | C |
| Polyacrylate thickener* | 1.5 | 1.5 | 1.5 |
| Sodium benzoate | 0.5 | 0.5 | 0.5 |
| Perfume | 0.2 | 0.2 | 0.2 |
| Dye | 0.006 | 0.006 | 0.006 |
| NaOH (to product pH 12–13) | 1.2 | 1.2 | 1.0 |
| Deionized water | | Balance | |

*As POLYGEL DK.

The thickened compositions of Example II are prepared by adding the POLYGEL DK powder to water at pH 2. This solution is neutralized with NaOH to form a thickened paste. The balance of the ingredients are combined in a separate container. The ingredients and thickened paste are then combined, and the final pH adjustment is made.

EXAMPLE III

The compositions of Example II are modified by replacing the octyl sulfate with sodium hexyl sulfate and an internal $C_8$ paraffin sulfonate, Na salt, respectively.

EXAMPLE IV (A AND B)

Other compositions herein include the following.

| | % (wt.) | | |
|---|---|---|---|
| Ingredient | Control | A | B |
| Octyl sulfate | 0 | 1.0 | 4.0 |
| $C_{12}$ dimethyl amine oxide | 1.8 | 1.8 | 1.0 |
| Hypochlorite | 1.0 | 1.0 | 1.0 |
| $C_{12}$ fatty acid (thickener) | 0.8 | 0.8 | 0 |
| Polyacrylate (thickener) | 0 | 0 | 1.5 |
| Perfume | 0.275 | 0.275 | 0.275 |
| Dye | 0.006 | 0.006 | 0.006 |
| NaOH | to pH 13 | to pH 13 | to pH 12.8 |
| Deionized water | | Balance | |
| Viscosity | 200 cps | 100 cps | 150 cps |

EXAMPLE V

The composition of Example IV B can be modified by deleting the amine oxide and increasing the hypochlorite levels to 2.0%. The composition of Example B can be thinned by removing the polyacrylate thickener and provided in the form of a spray-on liquid in an appropriate dispenser with a spray pump.

In any of the foregoing compositions, sodium silicate can optionally be added at levels of 0.04%–0.5%.

EXAMPLE VI

A solid composition which can be in granular or bar form is as follows.

| Ingredient | % (wt.) |
|---|---|
| Coconut soap | 50 |
| Sodium carbonate | 2 |
| Octyl sulfate | 20 |

-continued

| Ingredient | % (wt.) |
|---|---|
| $C_{12}$ dimethyl amine oxide | 20 |
| Water | Balance |

The composition of Example VI can be modified by the addition of 2% NaDCC to provide bleach activity. (As is known, solid compositions with NaDCC can be unstable if the water of hydration is too mobile. The formulator may wish to adjust usage levels, given due regard for this factor.)

EXAMPLE VII

Two foamer spray type products are formulated by mixing the following ingredients. Product pH is 13–13.5.

| Ingredient | % (wt.) | % (wt.) |
|---|---|---|
| Sodium octyl sulfate | 4.00 | 6.00 |
| Sodium dodecyl sulfate | 2.00 | 3.00 |
| Sodium hypochlorite | 1.10 | 1.10 |
| Sodium hydroxide | 0.80 | 0.80 |
| Silicate (sodium) | 0.04 | 0.04 |
| Perfume | 0.25 | 0.25 |
| Water | BALANCE | BALANCE |

The foregoing compositions exhibit good performance on kitchen dirt and greasy soap scum, have an acceptable sudsing profile, and rinse cleanly.

In addition to the foregoing, it has now been determined that the formulation of stable cleaning compositions of the present type containing the above disclosed short-chain surfactants can be carried out in a manner which provides not only optimal cleaning performance over a wide variety of soils, especially household kitchen type greasy soil and bathroom type soap scum soil, but also optimal bleach stability. According to the practice of this invention, the proper selection of the short- and long-chain surfactants and use of the proper levels of total surfactants in the most preferred compositions allow even concentrated compositions containing as much as 3% hypochlorite to be formulated. Such compositions have satisfactory stability under typical in-use conditions. In this regard, it is to be understood that the proper selection of both short-chain and long-chain surfactant components is important in order to maximize stability. While quite effective for their intended use under many circumstances, it has now been determined that higher levels (e.g., 2–4%) of the semipolar amine oxide surfactants may be sub-optimal under long-term storage conditions, especially at hypochlorite levels in the 2%–3% range. If semipolar surfactants are desired, long-chain ($C_{12}$ and above, typically $C_{12}$–$C_{18}$) phosphine oxides are a class of such surfactants which can be substituted for their amine oxide counterpart surfactants, and which exhibit improved stability in the presence of hypochlorite. Alternatively, and in addition to those disclosed hereinabove, stable anionic surfactants which can be used include the $C_{12}$–$C_{16}$ alkylphosphates, $C_{12}$–$C_{16}$ alkyl phosphonates, the family of surfactants sold under the name DOWFAX, including the sodium alkyl ($C_6$–$C_{16}$) diphenyloxide disulfonates, and the like. However, it has surprisingly been discovered that the $C_{11}$–$C_{13}$ alkylbenzene sulfonates ("LAS") are not optimal for use in bleach-containing compositions. Accordingly, if hypochlorite is used in the product, it is preferred to select a non-LAS surfactant.

Preferred long-chain surfactants include $C_{12}$ alkyl sulfate. Somewhat higher cleaning performance on greasy soils may be achieved using the $C_{14}$–$C_{18}$ alkyl sulfates. Likewise, the $C_{12}$–$C_{18}$ alkyl sulfonates may be used as the hypochlorite-stable long-chain surfactants herein. The presence of the short-chain surfactants in the manner of this invention not only enhances overall cleaning performance, but has the additional advantage that they help solubilize the $C_{14}$–$C_{18}$ alkyl sulfates and $C_{12}$–$C_{18}$ alkyl sulfonates in the liquid compositions. This additional solubilization effect is especially helpful when $C_{16}$–$C_{18}$ long-chain surfactants are being used in the compositions to achieve superior grease removal results. Typical usage levels range from about 1% to about 6% by weight of the compositions herein.

With regard to the short-chain surfactants, the preferred classes of materials remain the $C_6$–$C_8$ alkyl sulfates and sulfonates and $C_6$–$C_{10}$ paraffin sulfonates, with sodium octyl sulfate being most preferred. Typical usage levels range from about 2% to about 6% of the compositions herein.

Moreover, it has now been determined that when formulating base surfactant combinations which can be used to provide optimally stable hypochlorite-containing compositions comprising mixed long- and short-chain alkyl sulfates and paraffin sulfonates without the amine oxides, the overall total levels of short chain plus long chain surfactant should preferably not exceed about 10% by weight of the compositions, and preferably are in the range of from about 2% to about 10% by weight of the compositions. Of course, this can vary somewhat depending on the concentration of hypochlorite and the degree of stability which are ultimately desired. For example, at concentrations of about 1% hypochlorite the total concentration of surfactants can be as high as 10%; at hypochlorite concentrations of about 2%, the total concentration of surfactants can be up to about 6%; at hypochlorite concentrations of about 3%, the total concentration of surfactants can be up to about 4%.

In addition, when formulating compositions of the present type without amine oxides, it further transpires that the use of weight ratios of long-chain surfactant:short-chain surfactant of at least about 1:1, preferably about 1.5:1, but no more than about 5:1, can provide excellent cleaning benefits on both the aforementioned bathroom and kitchen-type soils. Thus, by taking into consideration the above-disclosed amounts of total surfactant levels and these long-chain:short-chain ratios, it is possible to provide products which are optimal both with respect to broad-scale cleaning performance and stability with hypochlorite.

The following Examples illustrate these matters in more detail. In the disclosed compositions, overall stability is measured by an "accelerated aging" type of test which consists of maintaining the composition at 50° C. for a period of 10 days, and then measuring hypochlorite levels. In this test, an acceptably stable composition has a hypochlorite level at the end of the test period which is at least about 60% of its level in the fresh composition.

EXAMPLE VIII

A spray composition which not only cleans surfaces but also removes common household mildew is as follows. Product pH is 13.0–13.5.

| Ingredient | % (wt.) |
|---|---|
| Sodium octyl sulfate | 2.00 |
| Sodium dodecyl sulfate | 4.00 |
| Sodium hypochlorite | 2.20 |
| Sodium hydroxide | 0.80 |
| Silicate (Na) | 0.04 |
| Perfume | 0.35 |
| Water | BALANCE |

EXAMPLE IX

A surfactant mixture suitable for use as-is, but designed especially for use in combination with up to 3% hypochlorite is as follows.

| Ingredient | % (wt.) |
|---|---|
| Sodium $C_8$ paraffin sulfonate | 3.00 |
| Dodecyldimethyl phosphine oxide | 4.5 |
| Sodium hydroxide | to pH 13.0 |
| Silicate (soluble) | 0.05 |
| Water | BALANCE |

EXAMPLE X

A clay-thickened composition is prepared by mixing 1.3% of BENTONE EW into the composition of Example VIII.

EXAMPLE XI

A thickened product is prepared using a high shear mill (TEKMAR) and comprises 1.3% BENTONE EW, 1% NaOCl, 1% dodecyl sulfate, 4% octyl sulfate, dye, perfume and a water carrier. The composition exhibits excellent cling to vertical surfaces.

What is claimed is:

1. A cleaning composition which consisting essentially of:

i) from 1% to 3% by weight, of a hypochlorite bleach;

ii) from 1% to 8% by weight, of a bleach-stable, long-chain surfactant selected from the group consisting of $C_{12}$–$C_{20}$ alkyl sulfates, $C_{12}$–$C_{20}$ alkyl sulfonates, $C_{12}$–$C_{20}$ alkenyl sulfonates, $C_{12}$ and higher alkyl benzene sulfonates, $C_{12}$ and higher phosphine oxides, $C_{12}$ and higher dialkyl amine oxides, and mixtures thereof;

iii) from 4% to 10% by weight, of a short-chain surfactant selected from the group consisting of $C_6$–$C_8$ alkyl sulfates, $C_6$–$C_8$ alkyl sulfonates, $C_6$–$C_{10}$ paraffin sulfonates, and mixtures thereof; and iv) an aqueous carrier, provided said composition has a pH of about 12 or higher.

2. A composition according to claim 1 wherein the weight ratio of surfactant (iii) to surfactant (ii) is greater than 1:1.

3. A composition according to claim 1 wherein the long-chain surfactant is not an amine oxide surfactant, and wherein the weight ratio of surfactant (iii) to surfactant (ii) is at least about 1:1.

4. A composition according to claim 3 wherein the long-chain surfactant is a non-amine oxide surfactant, and wherein the weight ratio of surfactant (iii) to surfactant (ii) is at least about 2:1.

5. A composition according to claim 1 consisting essentially of from about 1% to about 3% of hypochlorite bleach, from 1% to 6% by weight, of said long-chain surfactant, and from 4% to 6% by weight, of said short-chain surfactant.

6. A composition according to claim 5 consisting essentially of not more than about 10% by weight, of the mixture, of both long-chain and short-chain surfactants.

7. A composition according to claim 1 further comprising a thickener.

* * * * *